US009896321B2

(12) United States Patent
Willis

(10) Patent No.: US 9,896,321 B2
(45) Date of Patent: Feb. 20, 2018

(54) AUTO WATER DISPENSER CUTOFF

(71) Applicant: Electrolux Home Products, Inc., Charlotte, NC (US)

(72) Inventor: Timothy E. Willis, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/242,828

(22) Filed: Aug. 22, 2016

(65) Prior Publication Data

US 2016/0355388 A1 Dec. 8, 2016

Related U.S. Application Data

(63) Continuation of application No. 13/765,766, filed on Feb. 13, 2013, now Pat. No. 9,469,517.

(51) Int. Cl.

| | |
|---|---|
| ***B67D 1/00*** | (2006.01) |
| ***F25D 29/00*** | (2006.01) |
| ***B67D 1/16*** | (2006.01) |
| ***F25D 11/02*** | (2006.01) |
| ***F25D 23/12*** | (2006.01) |
| ***B67D 1/12*** | (2006.01) |
| ***B67D 1/08*** | (2006.01) |

(52) U.S. Cl.

CPC ..... *B67D 1/0014* (2013.01); *B67D 1/0858* (2013.01); *B67D 1/1247* (2013.01); *B67D 1/16* (2013.01); *F25D 11/02* (2013.01); *F25D 23/126* (2013.01); *F25D 29/005* (2013.01)

(58) Field of Classification Search

CPC ..... B67D 1/1247; B67D 1/16; F25D 11/02; F25D 29/005

USPC ..... 141/95, 96, 198

See application file for complete search history.

(56) References Cited

U.S. PATENT DOCUMENTS

| | | | |
|---|---|---|---|
| 3,094,154 | A | 6/1963 | Daniels |
| 3,678,753 | A | 7/1972 | Eggleston et al. |
| 3,913,401 | A | 10/1975 | Sweeney |
| 4,451,894 | A | 5/1984 | Dougherty et al. |
| 4,712,591 | A | 12/1987 | McCann et al. |

(Continued)

FOREIGN PATENT DOCUMENTS

| | | | |
|---|---|---|---|
| DE | 102010026866 | A1 | 1/2011 |
| GB | 2 449 630 | A | 12/2008 |
| TW | M424905 | U | 3/2012 |

*Primary Examiner* — Jason K Niesz

*Assistant Examiner* — James Hakomaki

(74) *Attorney, Agent, or Firm* — Pearne & Gordon LLP

(57) ABSTRACT

A refrigerator includes a refrigerated compartment and a door to open and close at least a portion of the refrigerated compartment. A dispenser is positioned on the door that is configured to dispense content into a receiver vessel. The dispenser includes a control unit, an actuation system controlled by the control unit, and a dispensing outlet through which the content flows from the dispenser and into the receiver vessel. The dispenser further includes a trough located below the dispensing outlet for collecting overflow content from at least one of the receiver vessel and the dispensing outlet. The dispenser further includes a sensor coupled to the trough and in electrical communication with the control unit. The sensor is configured to detect overflow content contained within the trough. A method for controlling the dispensing of content from a dispenser is also described.

9 Claims, 3 Drawing Sheets

(56) References Cited

U.S. PATENT DOCUMENTS 4,895,194 A 1/1990 McCann et al.
5,207,251 A * 5/1993 Cooks ..... G01F 23/16 137/240
5,542,572 A 8/1996 Davis
5,802,910 A 9/1998 Krahn et al.
5,827,428 A 10/1998 Chang
6,154,144 A * 11/2000 Johnson ..... G01F 23/243 137/312
6,679,400 B1 1/2004 Goodman
6,708,518 B1 3/2004 Jones et al.
6,827,097 B2 12/2004 Goodman
6,840,100 B1 1/2005 Wotiz
7,000,468 B2 2/2006 Doorhy et al.
7,171,993 B2 2/2007 Bethuy et al.
7,549,435 B2 6/2009 Walter
7,597,116 B2 * 10/2009 Detwiler ..... B60R 15/00 137/396
7,661,448 B2 2/2010 Kim et al.
7,814,582 B2 * 10/2010 Reddy ..... A47K 13/24 4/302
8,006,502 B2 8/2011 Kim et al.
2005/0039420 A1 2/2005 Albritton et al.
2008/0156008 A1 7/2008 Richmond et al.
2009/0183796 A1 7/2009 Chase et al.
2009/0266442 A1 * 10/2009 Duscher ..... G01F 23/243 141/95
2009/0314798 A1 12/2009 Hovinen et al.
2010/0037985 A1 * 2/2010 Waters ..... B65B 3/28 141/83
2010/0155415 A1 6/2010 Ashrafzadeh et al.
2010/0159077 A1 6/2010 Skalski et al.
2011/0070348 A1 3/2011 Burton-Wilcock et al.
2011/0153821 A1 6/2011 McCoy
2011/0203686 A1 * 8/2011 Carson-Rowland .. G01F 23/242 137/558
2011/0265562 A1 11/2011 Li
2012/0031523 A1 2/2012 Bertoni et al.

* cited by examiner

AUTO WATER DISPENSER CUTOFF

CROSS-REFERENCE TO RELATED APPLICATIONS

This application is a continuation of application of U.S. application Ser. No. 13/765,766, filed, Feb. 13, 2013, the entire disclosure of which is hereby incorporated herein by reference.

FIELD OF THE INVENTION

The present application relates generally to refrigeration appliances, and in particular to dispensing units associated with refrigeration appliances.

BACKGROUND OF THE INVENTION

Modern refrigeration appliances, such as household refrigerators for example, often include as one of their features a dispenser for dispensing content, the content typically being water and/or ice. Frequently, the dispenser is located within a recess in the exterior surface of a door of the appliance. The refrigeration appliance can take any one of a number of forms. For example, the refrigeration appliance can have freezer and fresh food compartments that are arranged side-by-side, the freezer compartment can be located above the fresh food compartment, or the freezer can be located below the fresh food compartment. In any case, separate doors can be provided for the freezer and fresh food compartments and a dispenser can be located within the recess in the exterior of at least one of the doors.

Conventionally, the dispenser can include at least an outlet for dispensing water and an outlet for dispensing ice. Associated with the water dispensing outlet can be a lever in the form of a cradle or other actuating device that is pivotally attached to the dispenser. In addition to a lever, the actuating device could also be used with other types of vessel detection such as optical, visual, or ultrasonic, etc. When water is to be dispensed, a receiver vessel, usually in the form of a beverage glass, is pressed against the lever thereby operating a switch or sensor so as to complete an electrical circuit between a source of electrical power and a solenoid-operated valve connected to a source of water. The completion of the electrical circuit opens the solenoid-operated valve (or even other types of valves, such as motor actuated valves, etc.) permitting the water to flow from the source of water to the water dispensing outlet.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a refrigerator comprises a refrigerated compartment and a door to open and close at least a portion of the refrigerated compartment. A dispenser is positioned on the door that is configured to dispense content into a receiver vessel. The dispenser comprises a control unit, an actuation system controlled by the control unit, and a dispensing outlet through which the content flows from the dispenser and into the receiver vessel. The dispenser further comprises a trough located below the dispensing outlet for collecting overflow content from at least one of the receiver vessel and the dispensing outlet. The dispenser further comprises a sensor coupled to the trough and in electrical communication with the control unit. The sensor is configured to detect overflow content contained within the trough.

In accordance with another aspect of the present invention, a method for controlling the dispensing of content from a dispenser, comprising the steps of dispensing content into a receiver vessel, and measuring a sensed value in a trough located below the dispensing outlet during the dispensing of content. The sensed value representing an overflow content level contained within the trough. The method further comprises the steps of comparing the sensed value to a reference value, and terminating the dispensing of content from the dispensing outlet when the sensed value differs from the reference value by a predetermined amount.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
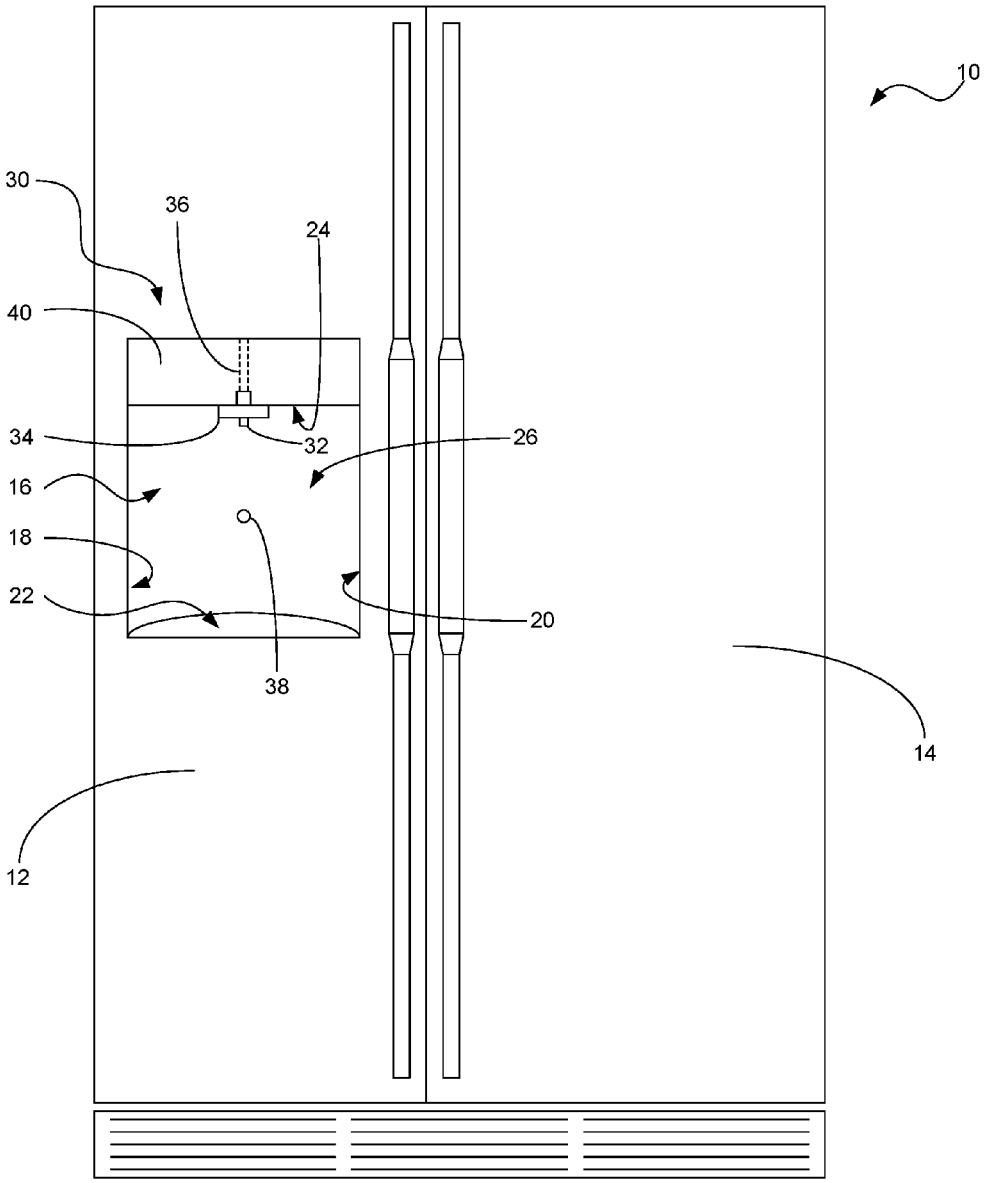
FIG. 1 is a schematic front elevation view of a refrigeration appliance illustrating one example dispensing unit.

Example embodiments that incorporate one or more aspects of the present application are described and illustrated in the drawings. These illustrated examples are not intended to be a limitation on the present application. For example, one or more aspects of the present application can be utilized in other embodiments and even other types of devices. Moreover, certain terminology is used herein for convenience only and is not to be taken as a limitation on the present application. Still further, in the drawings, the same reference numerals are employed for designating the same elements.

Turning to the shown example of FIG. 1, a refrigeration appliance in the form of a refrigerator 10 is illustrated as a side-by-side refrigerator with freezer and fresh food compartments. Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangement of the fresh food and freezer compartments with respect to one another in such refrigerators vary. For example, in some cases, the freezer compartment is located above the fresh food compartment (i.e., a top mount refrigerator), and in other cases the freezer compartment is located below the fresh food compartment (i.e. a bottom mount refrigerator). Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air. For example, a door 12 provides access to the freezer compartment, and a door 14 provides access to the fresh food compartment of the refrigerator. Both of the doors are pivotally coupled to a cabinet of the refrigerator 10 to restrict and grant access to the fresh food and freezer compartments.

Located generally centrally at the surface or exterior of the door 12 is an example dispenser indicated generally at 30. It is understood that dispenser 30 could also be located at various locations on the refrigerator door or even inside the refrigerator. As can best be seen in FIG. 1, the dispenser 30 is located in a recess 16 in the door 12. The recess comprises side walls or surfaces 18 and 20 that are opposite one another, a bottom or lower wall or surface 22, an upper or top wall or surface 24 and a back or rear wall or surface 26. A water dispensing outlet 32 for dispensing cold water and an ice dispensing outlet 34 for dispensing ice are located at the upper surface 24 of the recess 16. In the shown embodiment of FIG. 1, the dispenser 30 can include a single dispensing outlet for the water 32 and ice 34 arranged so as to substantially coincide with one another at the upper surface 24 of the recess 16. However, in an alternative embodiment (not shown), a single dispensing outlet for water 32 and a single dispensing outlet for ice 34 can be arranged so as to be spaced apart from one another at the upper surface 24 of the recess 16 across the width of the access door 12 and not coincide with each other. The bottom surface 22 of the recess 16 can include a trough and/or drain (see FIG. 2) for draining away excess water from the water dispensing outlet 32 and/or water formed from melting ice from the ice dispensing outlet 34 that comes to rest on the bottom surface 22.

Figure 2:
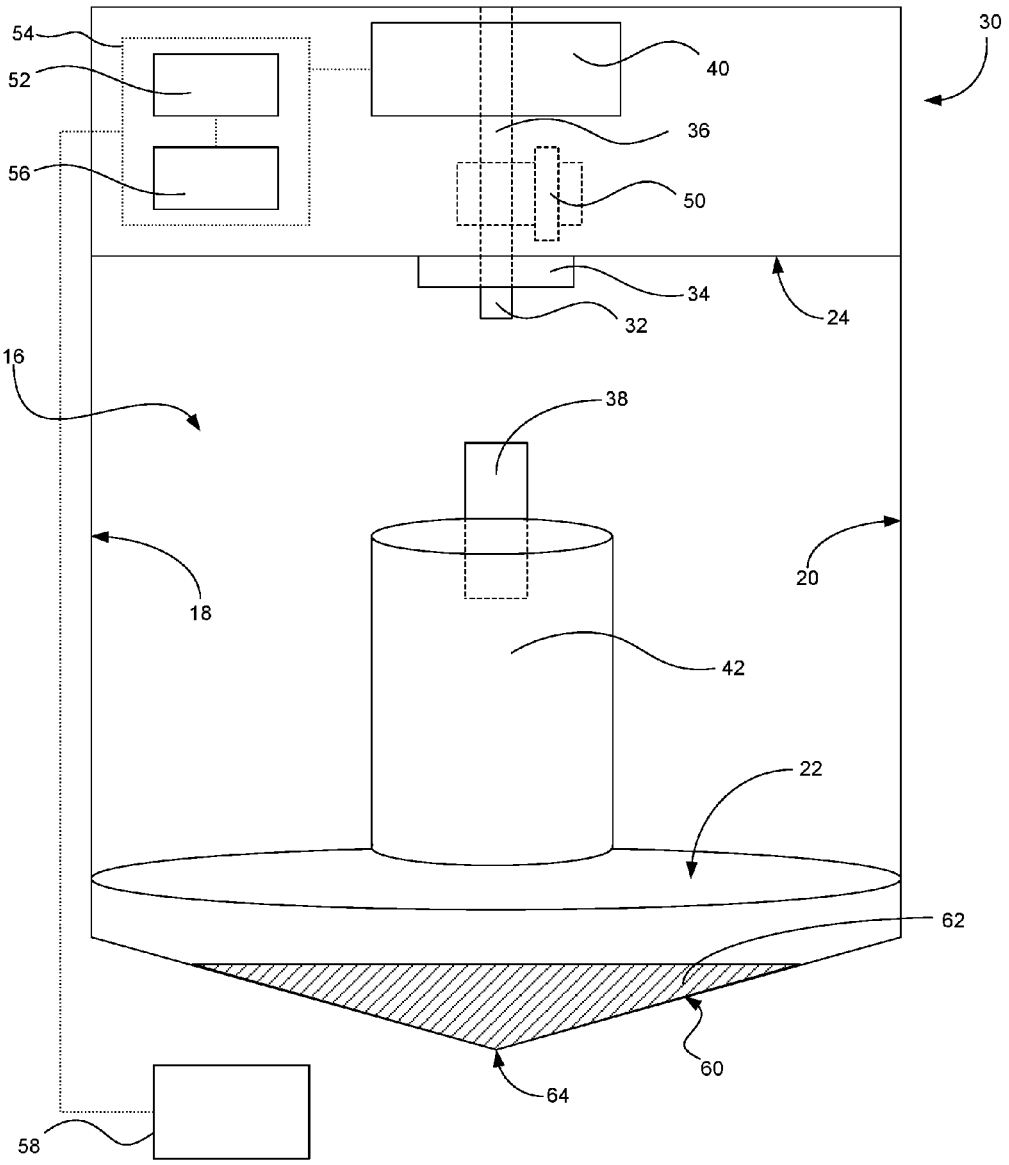
FIG. 2 is a detailed view of the example dispensing unit.

Turning to FIG. 2, at least one water line 36 extends from the water dispensing outlet 32 to a source of the water. The source of water can be, for example, a water reservoir connected to the household water supply system or the household water supply itself or such other sources as are familiar to those having ordinary skill in the art. A solenoid-operated valve 50 can be located in fluid communication with the water line 36 and can be controlled by control unit 54 that can include a microprocessor 52, for example as discussed below. Though described as a solenoid-operated valve 50, other types of valves can be used, such as motor actuated valves or the like. Additionally, at least one water filter can be located in fluid communication with the at least one water line 36 to purify the incoming water.

Keeping with the shown example of FIG. 2, a trough 60 can be located below the water dispensing outlet 32 and the ice dispensing outlet 34. The trough 60 collects overflow content that is typically spilled or overflowed water or ice from the water dispensing outlet 32, ice dispensing outlet 34, and/or receiver vessel 42. This overflow content is referred to herein as residual content 62. The trough 60 can be part of the bottom surface 22 that supports the receiver vessel 42, or even below the bottom surface 22. The trough 60 can have a geometry configured to capture and retain the residual content 62. In one example, the trough 60 can have a generally concave geometry so that the residual content 62 collected by the trough 60 pools generally towards a vertex or minimum 64 of the trough 60. The geometry of the trough 60 can also be a wedge, a "V", a "U", a "W", or a number of other designs with one or more local minimums.

The ice dispensing outlet 34 comprises essentially an opening in the upper surface 24 of the recess 16. The opening is in communication with a source of ice such as, for example, the ice storage bin of an ice making unit (not shown) located in the fresh food or freezer compartment of the refrigerator. Typically, as is familiar to those of ordinary skill in the art, the ice is delivered from the ice storage bin to the ice dispensing outlet 34 by an auger which upon activation rotates so as to drive the ice from the storage bin to the ice dispensing outlet 34. Activation of the auger can be accomplished by the control unit 54 that also controls the operation of a solenoid-operated valve 50 located in the water line 36, or by other control structure.

At least one switch 38 can be electronically coupled to the control unit 54 and be configured to dispense either or both of water from the water dispensing outlet 32 and ice from the ice dispensing outlet 34. Alternatively, separate switches (not shown) can be provided for each of the water dispensing outlet 32 and the ice dispensing outlet 34. The at least one switch 38 can be a contact-style switch, or can alternatively be non-contact style switch, including other types of vessel detection such as optical, visual, or ultrasonic, etc. In addition or alternatively, at least these functions can be controlled by the microprocessor 52, which can be appropriately programmed using information that is input by a user to a user interface 40 that is electrically connected to the microprocessor 52. Thus, when a receiver vessel 42 such as a glass is inserted within the recess 16 and the switch 38 is activated, water and/or ice can be dispensed on-demand into the receiver vessel 42.

Operation of the dispenser 30 can be controlled by a control unit 54. The control unit 54 can be comprised of various components, including the microprocessor 52 and/or an analog to digital converter (ADC) 56. The microprocessor 52 can be programmed in various ways to accept user inputs from a user interface 40. Additionally, the microprocessor 52 can receive signals from the ADC 56 and/or a sensor 58 to determine the amount of residual content 62 contained within the trough 60. Sensor 58 could include electrodes connected directly to a microcontroller, such that two separate microcontrollers could be used (52 and 58), or that the microcontroller connected directly to the electrodes (sensor 58) could serve both functions thus combining 52 and 58 into one. Thus, it is contemplated that the control unit 54 could be a main control unit of the appliance, or even a sub-control unit. Utilizing the residual content 62 level information with the user input data, the microprocessor 52 can determine when to dispense content and/or terminate the dispensing of content. The microprocessor 52 outputs a signal to control the solenoid-operated valves 50 of the dispenser 30. While the various examples discussed herein include a digital microcontroller, it is contemplated that full analog, full digital, or hybrid systems can be used. In one example, the ADC 56 can receive analog signals from the sensor 58 that detects the residual content 62 level in the trough 60. The ADC 56 can receive analog inputs (e.g., voltage, current, capacitance, and/or resistance), and convert the inputs into a corresponding digital output that is transmitted to the microprocessor 52. Still, the sensor 58 could directly output digital signals.

The sensor 58 can be configured to detect overflow content in the trough 60 in various ways. In one example shown in FIG. 3, the sensor 58A comprises at least one capacitive sensor 70, such as a plurality of capacitive sensors 72, coupled to the trough 60A. The trough 60A can be made from a dielectric material, such as plastic, glass, porcelain, rubber, or any other material that is a relatively poor conductor of electricity. When the trough 60A is made from a dielectric material, residual content 76 can influence the capacitance sensed by the capacitive sensor 70 or sensors 72. Generally, dielectric constants of liquids are greater than that of air; for example, the dielectric constant of water is 80 times that of air. This property allows for a measureable change in sensed capacitance as the level of residual content 76 changes within the trough 60A.

The capacitive sensor 70 or sensors 72 generally have a limited sensing range. When the capacitive sensor 70 or sensors 72 are coupled to the trough 60A at a fixed position and the residual content 76 level has not reached the sensing range of the capacitive sensor 70 or sensors 72, a sensed capacitance will change little, if at all. When the residual content 76 level reaches the sensing range of the capacitive sensor 70 or sensors 72, a dielectric effect of the residual content 76 changes a sensed capacitance detected by the capacitive sensor 70 or sensors 72. Thus, the level of residual content 76 within the trough 60A can be approximated by determining when the capacitive sensor 70 or sensors 72 have a change in sensed capacitance due to the level of residual content 76 rising in the trough 60A to within the sensing range of the capacitive sensor 70 or sensors 72.

In one example embodiment, only one capacitive sensor 70 is employed. This capacitive sensor 70 can be coupled to the trough 60A at a fixed position that is a known distance with respect to another fixed element, such as a vertex or local minimum 74 of the trough 60A. When the residual content 76 level rises to the fixed position of the capacitive sensor 70, a sensed capacitance increases. The capacitive sensor 70, in electrical communication with the control unit 54, communicates a signal representing the sensed capacitance to the control unit 54. Thus, because the distance between the capacitive sensor 70 and a fixed element such as the vertex or minimum 74 of the trough 60A can be known, the control unit 54 can accurately estimate the depth of the residual content 76.

The control unit 54 for a single capacitive sensor 70 implementation can determine the content depth and/or if an overflow condition exists in various manners. In one embodiment, the control unit 54 can determine that an overflow condition exists when the sensed capacitance at the capacitive sensor 70 changes. Any change in the sensed capacitance indicates that the residual content 76 level has reached the sensing range of the capacitive sensor 70.

In another embodiment of the control unit 54 for a single capacitive sensor 70 implementation, the control unit 54 can compare the sensed capacitance to a reference capacitance, and determine that an overflow condition exists when the sensed capacitance approaches or exceeds the reference capacitance. This reference capacitance can be predetermined. In one example, the predetermined reference capacitance can be static, or in another example, the predetermined reference capacitance can be variable. For example, the control unit 54 can be configured to determine a variable reference capacitance via a signal from the capacitive sensor 70 before the dispenser 30 is activated, which can be stored by the control unit 54 as the reference capacitance. Then, while the dispenser 30 is dispensing content, the capacitive sensor 70 measures the sensed capacitance at least once, such as two or more different times, and communicates signals representing the sensed capacitance(s) to the control unit 54. The control unit 54 can then compare the sensed capacitance(s) to the stored reference capacitance. If the sensed capacitance(s) is/are different than the reference capacitance by a predetermined amount, then the control unit 54 will determine that an overflow condition exists. The foregoing examples contemplate comparing capacitances greater and/or lower than a reference capacitance. These are just a few examples of how the control unit 54 can determine that an overflow condition exists in a single capacitive sensor implementation of the sensor 58.

The control unit 54 can further be configured to output a signal to the solenoid-operated valves 50 that terminates the dispensing of content when an overflow condition exists and/or prevents the dispensing of content when the trough 60A is determined to be full. The control unit 54 can determine that an overflow condition exists according to any of the previous examples, such as when the sensed capacitance equals or exceeds the static reference capacitance or a predetermined full-trough capacitance limit. When the control unit 54 determines that the trough 60A is no longer full, such as when the sensed capacitance falls below the reference capacitance or full-trough limit, and/or when an overflow condition no longer exists, the dispensing of content can resume.

Figure 3:
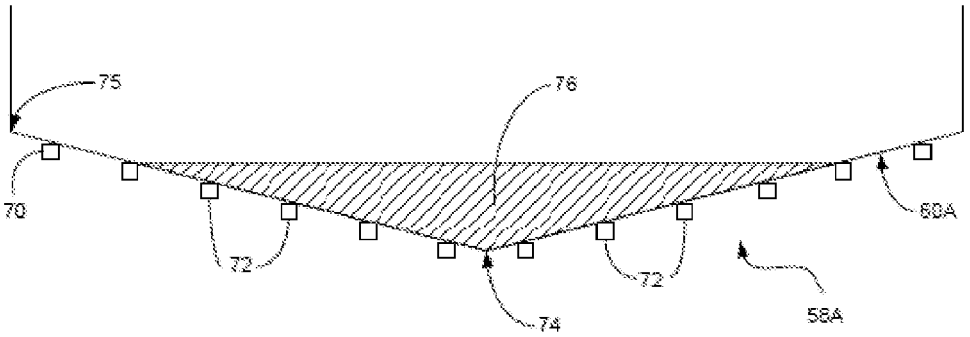
FIG. 3 is a schematic illustration of an example dispenser trough with a plurality of capacitive sensors coupled to the trough.

In another example shown in FIG. 3, a plurality of capacitive sensors 72 can be employed. The capacitive sensors 72 can be coupled to the trough 60A in numerous arrangements, such as various linear or circular patterns along one, two, or three axes. In one example, the capacitive sensors 72 can be arranged between points near a vertex or minimum 74 of the trough 60A and near the top 75 of the trough 60A. When a plurality of capacitive sensors 72 are employed, sensed capacitance measurements can be taken at multiple discrete locations, allowing for greater resolution in determining the level of residual content 76 within the trough 60A. The capacitive sensors 72, in electrical communication with the control unit 54, communicate one or more signals representing the sensed capacitance(s) of the various capacitive sensors 72 to the control unit 54. As before, because the distance between each capacitive sensor 72 and a fixed element such as the vertex or minimum 74 of the trough 60A can be known, the control unit 54 can accurately estimate the depth of the residual content 76 contained within the trough 60A. It is understood that the control unit 54 can utilize the plurality of sensed capacitances from the capacitive sensors 72 directly to determine whether an overflow condition exists, or can utilize the plurality of sensed capacitances indirectly by converting or translating them into a depth or height of the residual content 76 within the trough 60A.

The control unit 54 for an implementation of a plurality of capacitive sensors 72 can determine the content depth and/or if an overflow condition exists in various manners. In one example embodiment, the control unit 54 can determine that an overflow condition exists when the sensed capacitance exceeds a static reference capacitance by a predetermined amount. In this example, the control unit 54 can estimate the depth of the residual content 76 according to the capacitances measured by the capacitive sensors 72, but an overflow condition will not be generated until the measured capacitance approaches or exceeds the static reference capacitance by a predetermined amount.

In another example embodiment, a moving reference capacitance can be used by the microprocessor 52. This can accommodate situations where residual content 76 is already present in the trough 60A. The amount of residual content 76 in the trough can be measured prior to dispensing content, or if no measurement is taken prior to the dispensing of content, the last known reference capacitance stored by the control unit 54 can be used. While the dispenser 30 is dispensing content, the plurality of capacitive sensors 72 can measure the sensed capacitance at least once, such as two or more different times, and transmits signals representing the sensed capacitances to the control unit 54. The control unit 54 compares the sensed capacitances to the variable reference capacitance value. The difference between the sensed capacitances and the variable reference capacitance can be compared to determine if the change indicates the residual content 76 is increasing, and if so, the control unit 54 can determine that an overflow condition exists.

In another embodiment employing a plurality of capacitive sensors 72, a determination can be made of the rate of change of the residual content 76 level over time. The rate of change of the residual content 76 can be determined based upon a determination of the rate of change of the sensed depth of the residual content 76, or a rate of change of the sensed capacitances. The rate of change determination can be used with a static or variable reference value. While the dispenser 30 is dispensing content, the capacitive sensors 72 measure the sensed capacitance at least once, such as two or more different times, and transmit signals representing the sensed capacitances to the control unit 54. Using the two or more sensed values, the microprocessor 52 can determine a rate of change of the capacitances over time. If a sensed rate of change exceeds the reference value by a predetermined amount, the microprocessor 52 will determine that an overflow condition exists and will output a signal to the solenoid operated valves 50 that terminates the dispensing of content. In addition or alternatively, the control unit 54 can compare the sensed capacitances to the variable reference capacitance. The difference between the sensed capacitances and the variable reference capacitance represents the change in residual content 76 level over time. If the change indicates the residual content 76 is increasing, the control unit 54 can determine that an overflow condition exists.

In another embodiment employing the plurality of capacitive sensors 72, the control unit 54 can be configured to sum the capacitances of some or all of the capacitive sensors 72 instead of using data from each individual capacitive sensor. In this example, the control unit 54 can receive signals representing the sensed capacitances of each of the plurality of capacitive sensors 72, and compare the summation of the sensed capacitances to either a static reference capacitance or a variable reference capacitance.

In another embodiment, the plurality of capacitive sensors 72 can be further configured to determine that the trough 60A is full in various manners. In one embodiment employing a static reference capacitance, the control unit 54 can determine that the trough 60A is full when the sensed capacitance differs from the static reference capacitance by a predetermined amount. In an embodiment employing a variable reference capacitance, the control unit 54 can determine that the trough 60A is full when either the variable reference capacitance or the sensed capacitance differs from a full-trough capacitance by a predetermined amount. The variable reference capacitance can generally be determined after the dispensing of content has been terminated and before the dispensing of content has resumed. After the dispensing of content has been terminated, the depth of residual content 76 contained within the trough 60A can potentially be at or above the sensing range of the capacitive sensor nearest the top 75 of the trough 60A. The result is the variable reference capacitance being stored can equal the maximum detectable capacitance, making it difficult to generate future overflow conditions. To reduce this outcome, a full-trough capacitance can be predetermined and stored in the control unit 54. When the variable reference capacitance approaches, equals, or exceeds the predetermined full-trough capacitance, the control unit 54 can determine the trough 60A to be full. Thus, prior to the dispensing of content, the variable reference capacitance can represent at least one of an instant residual content level contained within a trough and a full-trough value.

As before, the control unit 54 can further be configured to output a signal to the solenoid-operated valves 50 that terminates the dispensing of content when an overflow condition exists and/or prevents the dispensing of content when the trough 60A is determined to be full. When the control unit 54 determines that an overflow condition no longer exists, such as when the variable reference capacitance falls below the full-trough capacitance limit and/or the sensed capacitance is less than the static reference capacitance, the dispensing of content can resume. The various embodiments of the control unit 54 are not intended to be an exhaustive list of possible implementations. Furthermore, it is contemplated that the control unit 54 can combine two or more of the embodiments described herein.

The user can be alerted that the trough 60A is full by an indicator light, an audible alarm, or other various methods. The alert can be displayed on the user interface 40 or dispenser 30, for example, or on the main control of the appliance. This will prompt the user to either empty the trough 60A, or wait until a portion of the residual content 76 has evaporated. The capacitive sensor 70 or sensors 72 can periodically measure capacitances and communicate signals representing the capacitances to the control unit 54. The control unit 54 can then compare these measured capacitances to either a static reference capacitance and/or a predetermined full-trough capacitance limit to determine whether the trough 60A is still full.

Figure 4:
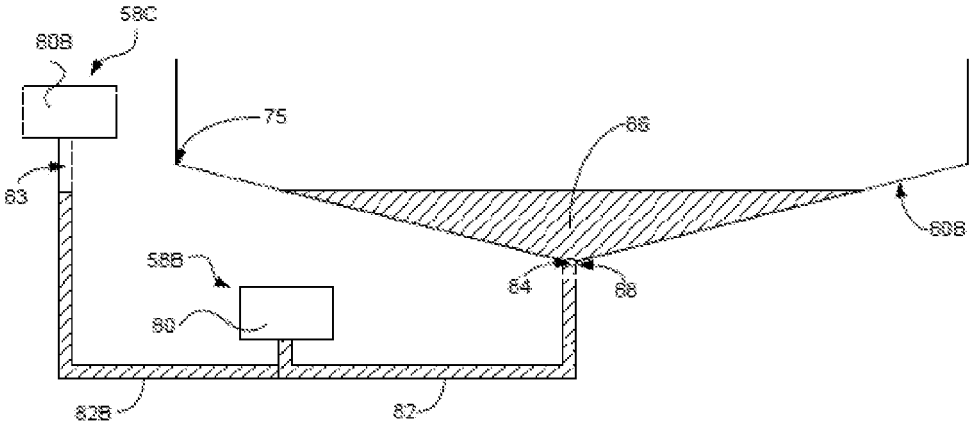
FIG. 4 is a schematic illustration of another example dispenser trough with a pressure transducer coupled to the trough.

Turning now to FIG. 4, another example sensor 58B, 58C embodiment is shown. The sensor 58B, 58C can be a fluid pressure transducer 80, 80B coupled to a trough 60B that can be utilized to detect the fluid pressure of residual content 86 contained within the trough 60B. The pressure transducer 80, 80B is coupled to the trough 60B by at least one capillary tube 82, which is in fluid communication with the trough 60B at a hole 84 located at a predetermined location, such as about a vertex or a local minimum 88 of the trough 60B. The pressure transducer 80, 80B is in fluid communication with the hole 84 via the capillary tube 82, 82B and is in electrical communication with the control unit 54. It is understood that the fluid pressure sensed by the pressure transducer can be either a liquid pressure, as shown by sensor 58B, or can be a gas pressure as shown by sensor 58C. One or more of the sensors 58B, 58C can be used alone or together. For brevity, it is understood that the discussion herein of the pressure transducer can include either of the liquid or gas pressure transducer 80, 80B embodiments even if only one is mentioned.

The trough 60B, located below the dispensing outlet for water 32 and/or the dispensing outlet for ice 34, can have a generally concave geometry so that content collected by the trough 60B pools generally towards a vertex or a minimum 88 of the trough 60B. The geometry of the trough 60B can also be a wedge, a "V", a "U", a "W", or a number of other designs with one or more one local minimum. As shown, the hole 84 is located generally at or near the vertex or minimum 88 of the trough 60B. One end of the capillary tube 82 is attached to the hole 84 and the other end of the capillary tube 82 is attached to the pressure transducer 80, 80B. While this embodiment describes utilizing one pressure transducer 80, 80B, one capillary tube 82, and one hole 84, it can be appreciated that the design can include multiple pressure transducers, each with one or more corresponding capillary tube(s) and hole(s) and coupled to the trough 60B at predetermined locations.

Residual content 86 contained within the trough 60B enters the capillary tube 82 and travels to the pressure transducer 80, 80B, where the residual content 86 exerts a fluid pressure against the pressure transducer 80, 80B. As the residual content 86 level rises, the fluid pressure exerted by the residual content 86 against the pressure transducer 80, 80B increases. As noted, the fluid pressure sensed by the pressure transducer can be either a liquid pressure 58B or a gaseous pressure 58C. Depending on the type of pressure transducer, it may be mounted below the fluid level (see pressure transducer 80) so that it has liquid contact (e.g., liquid contact), or it may be mounted above the fluid level (see pressure transducer 80B) so that the liquid is not in direct contact with the sensor, but the fluid height would compress a gas column 83 (e.g., air or other gas) which is in contact with the pressure transducer 80B.

In one example, where fluid pressure increases linearly, the controlling equation for measuring pressure is $P=\rho gh$, where $\rho$ is the density of the residual content 86 contained within the trough 60B, g is gravity, and h is the height or level of the residual content 86 contained within the trough 60B. The height h can be measured with respect to a fixed point, such as the location of the hole 84 (e.g., the vertex 88 or another point). The density of the residual content 86 (e.g., water) and gravity are generally constant, resulting in the pressure being a function of only the level of residual content 86 contained within the trough 60B. Therefore, the residual content 86 level (i.e., height h) can be accurately predicted based upon the pressure detected by the pressure transducer 80, 80B. The output of the pressure transducer 80, 80B can be of various types, including voltage, current, or a number of other outputs. In one example, the output of the pressure transducer 80, 80B is an analog voltage that can increase as the pressure exerted on the pressure transducer 80, 80B increases. The analog voltage output is transmitted to the control unit 54. Still, various analog or digital signals can be output by the pressure transducer 80, 80B. It is contemplated that the control unit 54 and/or pressure transducer 80, 80B can compensate for such as local temperature, barometric or meteorological characteristics of where the refrigerator is located, and make appropriate adjustments, especially where the pressure of a compressed gas column 83 (e.g., air or other gas) is used.

The control unit 54 can determine that an overflow condition exists in various ways, including when a sensed pressure exceeds a reference pressure by a predetermined amount. In one embodiment, the reference pressure can be a fixed reference pressure. When the dispenser 30 is dispensing content, the pressure transducer 80, 80B can be configured to measure the pressure of the residual content 86 at least one, such as two or more different times, and communicate signals representing the sensed pressures to the control unit 54. The microprocessor 52 receives signals representing the sensed pressures and compares each sensed pressure to the fixed reference pressure. If a sensed pressure differs (e.g., greater or lesser) from the fixed reference pressure by a predetermined amount, the microprocessor 52 will determine that an overflow condition exists and will output a signal to the solenoid operated valve 50 that terminates the dispensing of content.

In another example embodiment, a moving reference pressure can be used by the microprocessor 52. This can accommodate situations where residual content 86 is already present in the trough 60B. The amount of residual content 86 in the trough can be measured prior to dispensing content, or if no measurement is taken prior to the dispensing of content, the last known reference pressure stored by the control unit 54 can be used. While the dispenser 30 is dispensing content, the pressure transducer 80, 80B measures the sensed pressure at least once, such as two or more different times, and transmits signals representing the sensed fluid pressure to the control unit 54. The control unit 54 compares the sensed pressures to the variable reference pressure value. The difference between the sensed pressures and the variable reference pressure can be compared to determine if the change indicates the residual content 86 is increasing, and if so, the control unit 54 can determine that an overflow condition exists and will output a signal to the solenoid operated valves 50 that terminates the dispensing of content.

In another example, a determination can be made of the rate of change of the residual content 76 level over time, and an overflow condition can be generated when a rate change in pressure over time is greater than a predetermined amount. The rate of change of the residual content 86 can be determined based upon a determination of the rate of change of the sensed depth of the residual content 86, or a rate of change of the sensed pressure. In order to determine whether there is a change in pressure, first a reference pressure can be measured (or the last known reference pressure stored by the control unit 54 can be used) before the dispenser 30 begins dispensing content. The reference pressure is communicated to the control unit 54, and the value representing the reference pressure is stored in the microprocessor. This can allow the microprocessor 52 to accurately predict the residual content 86 level when the dispenser 30 is not dispensing content. When the dispenser 30 begins dispensing content, the pressure transducer 80, 80B can measure the sensed pressure at two or more different times and communicate signals representing the sensed pressures to the control unit 54. The microprocessor 52 then compares the sensed pressures to the previously stored moving reference pressure. Using the two or more sensed values, the microprocessor 52 can determine a rate of change of the pressure over time. If a sensed rate of change exceeds the reference value by a predetermined amount, the microprocessor 52 will determine that an overflow condition exists and will output a signal to the solenoid operated valves 50 that terminates the dispensing of content. In addition or alternatively, if a sensed pressure exceeds the moving reference pressure by a predetermined amount, the microprocessor 52 will determine that an overflow condition exists and will output a signal to the solenoid operated valves 50 that terminates the dispensing of content.

The microprocessor 52 can further be configured to prevent the dispensing of content when the trough 60B is determined to be full. When a sensed pressure or a moving reference pressure equals or exceeds a predetermined maximum fill pressure, the microprocessor 52 can determine that the trough 60B is full prevent the dispensing of content.

A user can be alerted that the trough 60B is full by an indicator light, an audible alarm, or other various methods. The alert can be displayed on the user interface 40 or dispenser 30, for example, or on the main control of the appliance. This will prompt the user to either empty the trough 60B, or wait until at least a portion of the residual content 86 has evaporated. The pressure transducer 80, 80B can periodically measure the pressure so that the microprocessor 52 can compare this measured pressure to the maximum fill pressure in order to determine when the trough 60B is no longer full.

When the control unit 54 determines that the trough 60B is no longer full, such as when the sensed pressure or moving reference pressure falls below the predetermined maximum fill pressure, the dispensing of content can resume. It is also contemplated that the control unit 54 can alter, such as increase or reduce, the flow rate of fluid provided by the dispenser. For example, if the control unit 54 determines that the amount of residual content in the trough is increasing but has not yet reached a maximum value, the control unit 54 could reduce the flow rate of the dispenser to a lower but non-zero amount. Once it is determined that the residual content has reached a maximum value for the trough, the control unit 54 can then completely terminate dispensing. Similarly, the flow rate of the dispenser could be stored in memory, and if the amount of residual content in the trough has not reduced sufficiently, a subsequent filling operation could utilize the previous low-flow filling rate. Conversely, if the trough has been reduced or emptied between filling operations, the flow rate of the dispenser could be increased.

It is contemplated that, in relation to sensed values by the sensor, use of the word "exceeds" (and similar words/phrases) refers to sensed values that differ to greater or lesser amount as compared to a known value. Thus, a sensed value can exceed a known value by being greater than or less than the known value by a certain amount.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator comprising:

a refrigerated compartment;

a door to open and close at least a portion of the refrigerated compartment;

a dispenser positioned on the door that is configured to dispense content into a receiver vessel, the dispenser comprising:

a control unit;

an actuation system comprising a valve, said actuation system being controlled by and in electrical communication with the control unit for operation between a dispensing condition and a non-dispensing condition;

a dispensing outlet connected to the actuation system and through which the content flows, when the actuation system is in the dispensing condition, from the dispenser and into the receiver vessel;

a trough on the door located below the dispensing outlet that supports the receiver vessel and comprising a generally concave geometry for collecting overflow content spilled into the trough from at least one of the receiver vessel and the dispensing outlet; and a sensor coupled to the trough and in electrical communication with the control unit, the control unit configured to detect a level of overflow content contained within the trough based upon input from the sensor, wherein the sensor comprises:

a pressure transducer configured to sense a fluid pressure of the overflow content contained within the trough and communicate the fluid pressure sensed to the control unit;

a capillary tube; and a hole at a predetermined location of the trough, wherein the pressure transducer is in fluid communication with the hole via the capillary tube, wherein the control unit determines that an overflow condition exists when the fluid pressure sensed by the pressure transducer exceeds a reference pressure by a predetermined amount to indicate that a depth of the overflow content contained within the trough is increasing while the actuation system is in the dispensing condition and content is being dispensed from the dispensing outlet, the reference pressure is a variable reference pressure measured in the trough immediately prior to content being dispensed from the dispensing outlet that represents an instant residual content level contained within the trough, and the fluid pressure sensed is measured by the pressure transducer at least twice while content is actively being dispensed from the dispensing outlet, and wherein the control unit alters the actuation system to the non-dispensing condition and thereby terminates dispensing of content from the dispensing outlet when the control unit determines that the overflow condition exists.

2. The refrigerator according to claim 1, wherein the pressure transducer is mounted lower than the overflow content and is configured to sense the fluid pressure of a liquid contained within the trough.

3. The refrigerator according to claim 1, wherein the concave geometry of the trough comprises a vertex, and wherein the reference pressure is a predetermined static pressure that is associated with a predetermined depth of the overflow content contained within the trough relative to said vertex.

4. The refrigerator according to claim 1, wherein the control unit determines that an overflow condition exists when a rate of change of the sensed pressure as compared to the reference pressure exceeds a predetermined rate of change while content is being dispensed.

5. The refrigerator according to claim 4, wherein the rate of change is based upon a determination of the rate of change of the sensed depth of the residual content.

6. The refrigerator according to claim 1, wherein the pressure transducer is mounted lower than the trough so that the pressure transducer has contact with liquid contained within the trough.

7. The refrigerator according to claim 1, wherein at least one of the pressure transducer and the control unit compensates the fluid pressure sensed for at least one of ambient temperature and barometric pressure of the environment about the trough.

8. The refrigerator according to claim 1, wherein the pressure transducer is mounted higher than a top level of the overflow content and is configured to sense the fluid pressure of a gas.

9. The refrigerator according to claim 1, wherein the pressure transducer is mounted higher than a top edge of the trough so that the pressure transducer does not have contact with liquid contained within the trough.

* * * * *